US011062870B2

(12) United States Patent
Beck et al.

(10) Patent No.: US 11,062,870 B2
(45) Date of Patent: Jul. 13, 2021

(54) INTEGRATED FUSE MODULE

(71) Applicant: Littelfuse, Inc., Chicago, IL (US)

(72) Inventors: Michael Beck, Remscheid (DE); Alfred Sadrinna, Hagen (DE); Julio Urrea, Hudson, OH (US); Gary Bold, Palatine, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/644,046

(22) PCT Filed: Sep. 24, 2018

(86) PCT No.: PCT/US2018/052370

§ 371 (c)(1),
(2) Date: Mar. 3, 2020

(87) PCT Pub. No.: WO2019/060805

PCT Pub. Date: Mar. 28, 2019

(65) Prior Publication Data

US 2020/0273655 A1 Aug. 27, 2020

Related U.S. Application Data

(60) Provisional application No. 62/561,848, filed on Sep. 22, 2017.

(51) Int. Cl.
*H01H 85/20* (2006.01)
*H01H 85/02* (2006.01)
(Continued)

(52) U.S. Cl.
CPC .... *H01H 85/2045* (2013.01); *H01H 85/0241* (2013.01); *H01H 85/12* (2013.01);
(Continued)

(58) Field of Classification Search
CPC ..... H01H 85/2045; H01H 85/0241; H01H 85/12; H01H 2085/025; H01H 2085/0555;
(Continued)

(56) References Cited

U.S. PATENT DOCUMENTS 4,531,806 A 7/1985 Hsieh
5,643,693 A * 7/1997 Hill ..... H01M 2/348 429/121
(Continued)

OTHER PUBLICATIONS

International Search Report and Written Opinion dated Nov. 26, 2018 for PCT/US2018/052370 filed Sep. 24, 2018.

*Primary Examiner* — Stephen S Sul
(74) *Attorney, Agent, or Firm* — Kacvinsky Daisak Bluni PLLC

(57) ABSTRACT

A fuse module including a mounting block formed of an electrically insulating material, a fuse plate including a fusible element disposed on a bottom surface of the mounting block, a fuse terminal electrically connected to the fusible element and extending along rear and top surfaces of the mounting block, and an input terminal electrically connected to the fusible element and extending from a front surface of the mounting block, the fuse module further including an electrically conductive terminal post extending from the top surface of the mounting block through the fuse terminal for facilitating connection to an electrical component.

20 Claims, 12 Drawing Sheets

(51) Int. Cl.
*H01H 85/12* (2006.01)
*H01H 85/055* (2006.01)

(52) U.S. Cl.
CPC ..... *H01H 2085/025* (2013.01); *H01H 2085/0555* (2013.01); *H01H 2085/208* (2013.01)

(58) Field of Classification Search
CPC ..... H01H 2085/208; H01H 2085/206; H01H 85/143
USPC ..... 337/180, 186, 187, 189, 191, 197, 207, 337/208, 216, 414
See application file for complete search history.

(56) References Cited

U.S. PATENT DOCUMENTS 5,905,047 A 5/1999 Sasage et al.
7,329,158 B1 * 2/2008 Roberts ..... H01R 13/115 439/825
7,499,262 B1 * 3/2009 Darr ..... H01R 9/226 361/626
7,978,046 B2 * 7/2011 Ohashi ..... H01H 85/175 337/186
9,425,018 B2 * 8/2016 Nohara ..... H01H 85/201
9,842,718 B1 * 12/2017 Carnick ..... H01H 85/0241
10,403,462 B2 * 9/2019 Allcorn ..... H01H 85/205
2002/0163416 A1 * 11/2002 Matsumura ..... H01H 85/044 337/112
2010/0019572 A1 * 1/2010 Kudo ..... H01H 85/044 307/10.7
2010/0051311 A1 * 3/2010 Nakagawa ..... H01R 11/287 174/59
2010/0060407 A1 * 3/2010 Iwata ..... H01H 85/143 337/227
2010/0328018 A1 * 12/2010 Matsumoto ..... H01H 85/0417 337/187
2011/0148564 A1 6/2011 Staylor
2011/0285496 A1 11/2011 Urrea et al.
2012/0020036 A1 * 1/2012 Matsumoto ..... H01H 85/044 361/752
2012/0064771 A1 * 3/2012 Urrea ..... H01H 85/205 439/620.29
2012/0293295 A1 11/2012 Kibushi et al.
2015/0130584 A1 * 5/2015 Totsuka ..... H01H 61/04 337/186
2015/0155120 A1 * 6/2015 Nohara ..... H01M 2/34 337/189
2017/0324233 A1 * 11/2017 Kimura ..... H01H 85/175
2017/0327064 A1 * 11/2017 Leverett, Jr. ..... B60R 16/033
2018/0019085 A1 * 1/2018 Kawase ..... H01H 85/20
2018/0047538 A1 * 2/2018 Ohashi ..... H01H 85/0241

* cited by examiner

16

INTEGRATED FUSE MODULE

CROSS-REFERENCES TO RELATED APPLICATIONS

This application claims the benefit of U.S. Provisional Patent Application No. 62/561,848, filed Sep. 22, 2017, the entirety of which is incorporated herein by reference.

FIELD OF THE DISCLOSURE

The disclosure relates generally to the field of circuit protection devices and relates more particularly to an integrated fuse module for automotive battery applications.

BACKGROUND OF THE DISCLOSURE

In the global automotive market there has been a trend toward implementing so-called "pre-fuse boxes" disposed within automobile engine compartments and connected to automobile battery terminals. The main purpose of a pre-fuse box in an automobile is to prevent electrical damage that may result from short-circuiting in high-current-conducting wires that may occur in the event of an accident.

Existing pre-fuse boxes are typically quite large and are mounted adjacent automobile batteries with flexible, conductive leads providing electrical connections therebetween. This configuration takes up a great deal of space within an automobile engine compartment where space is already very limited.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A fuse module in accordance with an exemplary embodiment of the present disclosure may include a mounting block formed of an electrically insulating material, a fuse plate including a fusible element disposed on a bottom surface of the mounting block, a fuse terminal electrically connected to the fusible element and extending along rear and top surfaces of the mounting block, and an input terminal electrically connected to the fusible element and extending from a front surface of the mounting block, the fuse module further including an electrically conductive terminal post extending from the top surface of the mounting block through the fuse terminal for facilitating connection to an electrical component.

A fuse module in accordance with another exemplary embodiment of the present disclosure may include a mounting block formed of an electrically insulating material, the mounting block including first and second portions that fit together and that have interior channels formed therein, a fuse plate partially disposed within the mounting block and extending through the interior channels of the first and second portions, the fuse plate comprising, a fusible element disposed adjacent, and oriented parallel to, a bottom surface of the mounting block, a fuse terminal electrically connected to the fusible element and extending adjacent, and parallel to, rear and top surfaces of the mounting block, and an input terminal electrically connected to the fusible element and extending from a front surface of the mounting block, the fuse module further including an electrically conductive terminal post extending through the fuse terminal for facilitating connection to an electrical component.

DETAILED DESCRIPTION

An integrated fuse module in accordance with the present disclosure will now be described more fully with reference to the accompanying drawings, in which preferred embodiments of the fuse module are presented. It will be understood, however, that the fuse module may be embodied in many different forms and should not be construed as being limited to the embodiments set forth herein. Rather, these embodiments are provided so that this disclosure will convey certain exemplary aspects of the fuse module to those skilled in the art.

Figure 1:
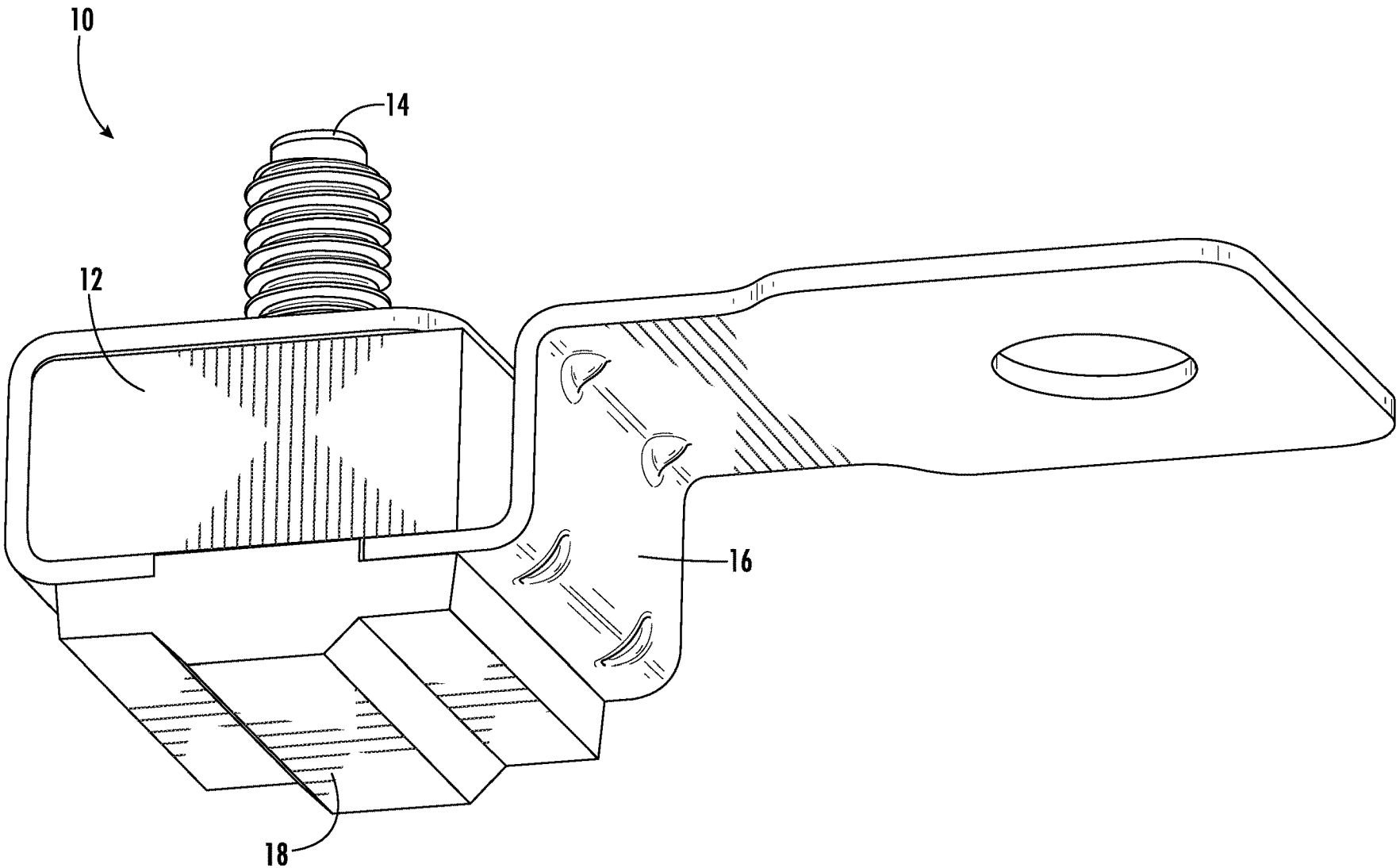
FIG. 1 is a front perspective view illustrating a fuse module in accordance with an exemplary embodiment of the present disclosure.

Referring to FIG. 1, a perspective view illustrating an integrated fuse module 10 (hereinafter "the fuse module 10") in accordance with an exemplary, non-limiting embodiment of the present disclosure is shown. As will be described in greater detail below, the fuse module 10 may be coupled directly to a positive terminal of an automobile battery, or to a busbar used for electrical power distribution, with no flexible electrical conductors extending therebetween, and may provide overcurrent protection for one or more electrical loads that are powered by the battery or other electrical power source. Advantageously, the fuse module 10 includes an integrated mounting structure that allows the fuse module 10 to be implemented in a compact, space-saving form factor relative to pre-fuse boxes that are currently available on the market.

For the sake of convenience and clarity, terms such as "front," "rear," "top," "bottom," "up," "down," "vertical," and "horizontal" may be used herein to describe the relative placement and orientation of various components of the fuse module 10, each with respect to the geometry and orientation of the fuse module 10 as it appears in FIG. 1. Said terminology will include the words specifically mentioned, derivatives thereof, and words of similar import.

Figure 2B:
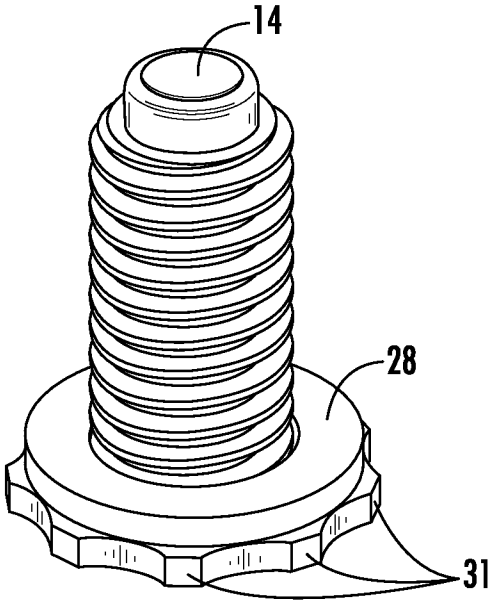
FIG. 2*b* is a detailed perspective view illustrating a terminal post of the fuse module shown in FIG. 1.
Figure 2A:
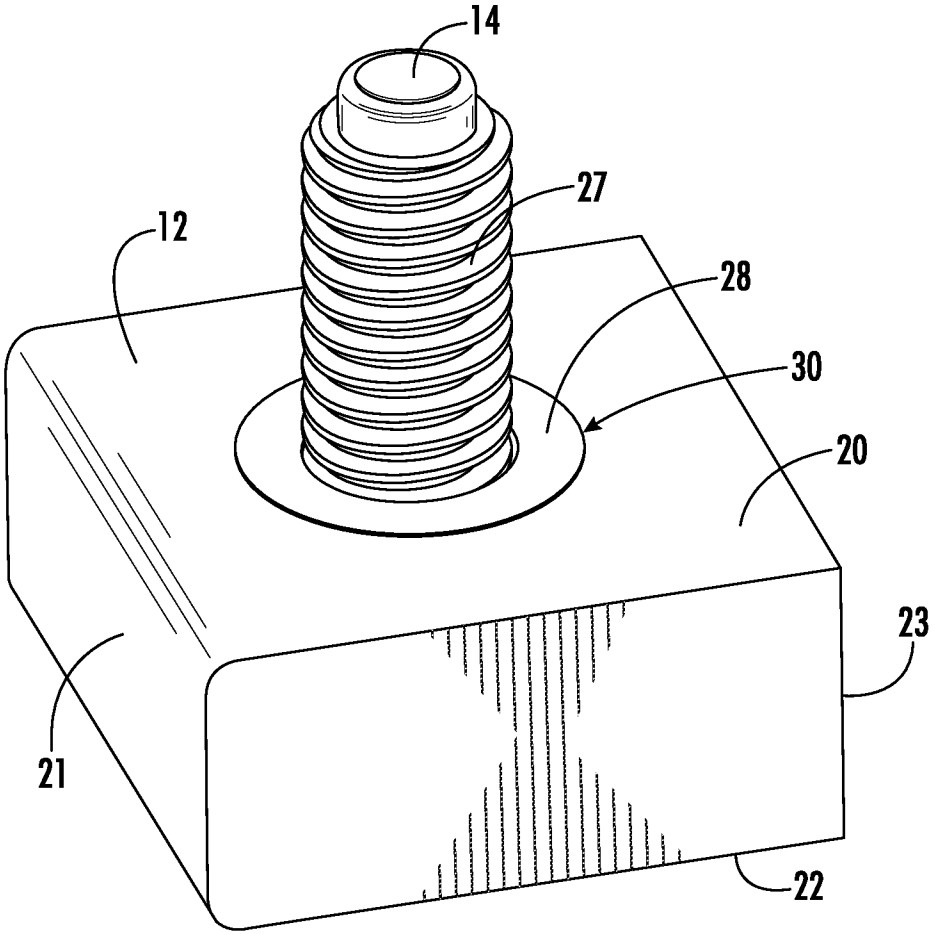
FIG. 2*a* is a perspective view illustrating a mounting block and terminal post of the fuse module shown in FIG. 1.

The fuse module 10 may generally include a mounting block 12, a terminal post 14, a fuse plate 16, and a cover 18. Referring to FIG. 2*a*, a perspective view illustrating the mounting block 12 and the terminal post 14 is shown with the fuse plate 16 and the cover 18 omitted for clarity. The mounting block 12 may be a rectangular cuboid formed of an electrically insulting material (e.g., plastic, polymer, ceramic, etc.), and may generally include a top surface 20, a rear surface 21, a bottom surface 22, and a front surface 23. The bottom surface 22 may have a trough 29 formed therein (see FIG. 4*b*) as further described below. The terminal post 14 may extend vertically from the top surface 20 of the mounting block 12 and may include a threaded shaft 27 with a mounting flange 28 extending radially from a lower end thereof. The mounting flange 28 may be disposed within a cavity 30 in the top surface 20. A top of the mounting flange 28 may be exposed and may be substantially coplanar with, or disposed slightly above, the top surface 20 of the mounting block 12. In one example, the mounting block 12 may be over-molded onto the mounting flange 28. The mounting flange 28 may include radial protrusions 31 (see FIG. 2*b*), similar to teeth of a gear, which may be embedded within the mounting block 12 and may thus prevent the mounting flange 28 from being withdrawn from the cavity 30 and from rotating within the cavity 30.

Figure 3:
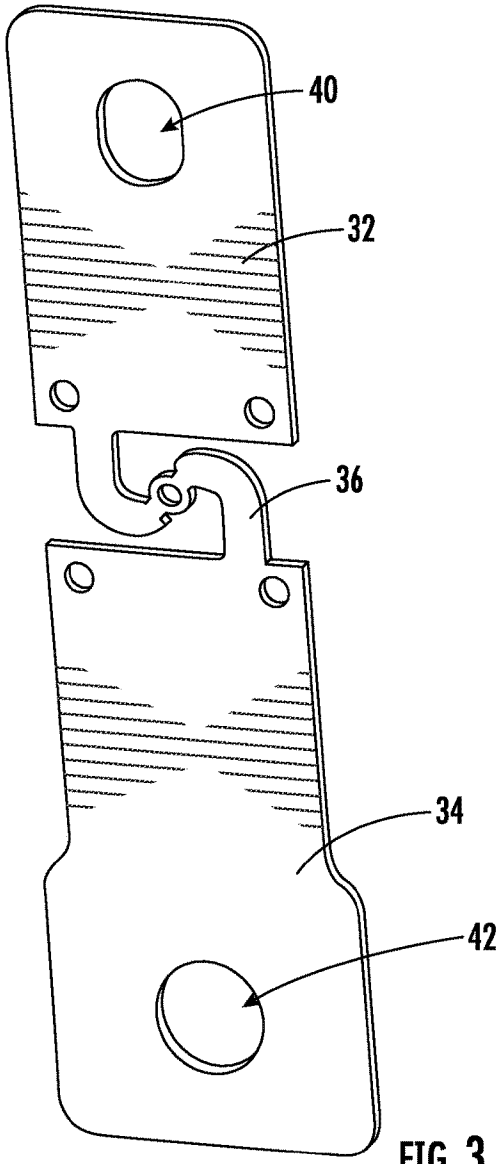
FIG. 3 is perspective view illustrating a fuse plate of the fuse module shown in FIG. 1.

Referring to FIG. 3, a perspective view illustrating the fuse plate 16 in isolation and in an unassembled state is shown. The fuse plate 16 may be formed from a single piece of conductive material (e.g., stamped from a single sheet of copper) and may include a fuse terminal 32 connected to an input terminal 34 by a fusible element 36. The fuse terminal 32 and the input terminal 34 may include respective mounting apertures 40, 42 formed therethrough. In a non-limiting, exemplary embodiment, the fuse plate 16 may be formed of copper sheet with a thickness in a range of 0.8-2.0 millimeters, for example, and the fusible element 36 may have a rating of 80 amps. It will be appreciated that the fuse plate 16 is not limited in this regard, and that the fuse plate 16 may be formed of various other conductive materials and/or with different thicknesses to achieve different current ratings in the fusible element 36.

Figure 4A:
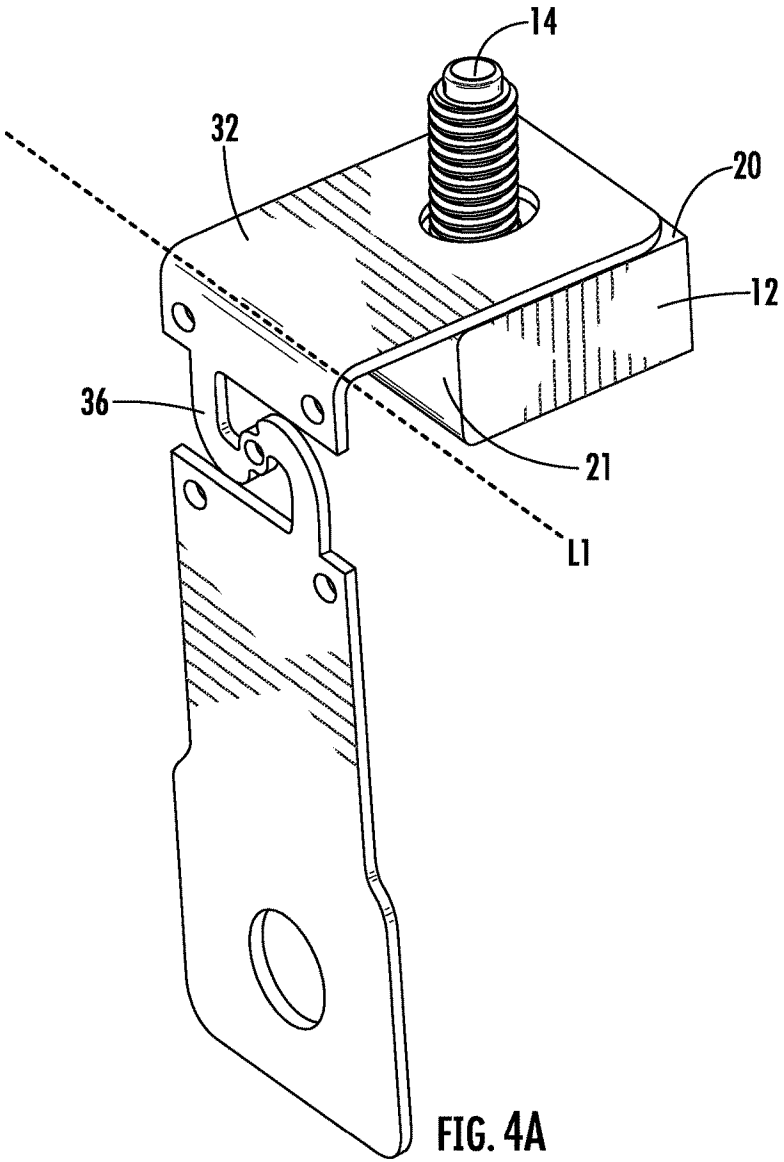
FIGS. 4*a*-4*c* are a series of perspective views illustrating a manner in which the fuse plate shown in FIG. 3 may be bent or folded during assembly of the fuse module 10 shown in FIG. 1.

During assembly of the fuse module 10, the fuse plate 16 may be bent or folded such that the fuse plate 16 may be wrapped about the mounting block 12 in a conformal relationship with surfaces thereof. For example, referring to FIGS. 4*a*-4*c*, a series of views are presented that illustrate one manner in which the fuse plate 16 may be bent or folded about the mounting block 12 during assembly of the fuse module 10. Specifically, in a first assembly step shown in FIG. 4*a*, the fuse terminal 32 may be placed on the top surface 20 of the mounting block 12 with the terminal post 14 extending through the mounting aperture 40, and the fuse terminal 32 may be bent or folded 90 degrees about a first fold line L1 that is parallel to, and spaced apart from, the rear surface 21 of the mounting block 12 to make the fusible element 36 parallel with the rear surface 21.

In a second assembly step shown in FIG. 4*b*, the fuse terminal 32 may be bent or folded 90 degrees about a second fold line L2 that is parallel with the first fold line L1 (see FIG. 4*a*) and that is adjacent a rear edge of the top surface 20, thus disposing a portion of the fuse terminal 32 in flat abutment with the rear surface 21 and disposing the fusible element 36 directly below the trough 29 in the bottom surface 22.

Figure 4B:
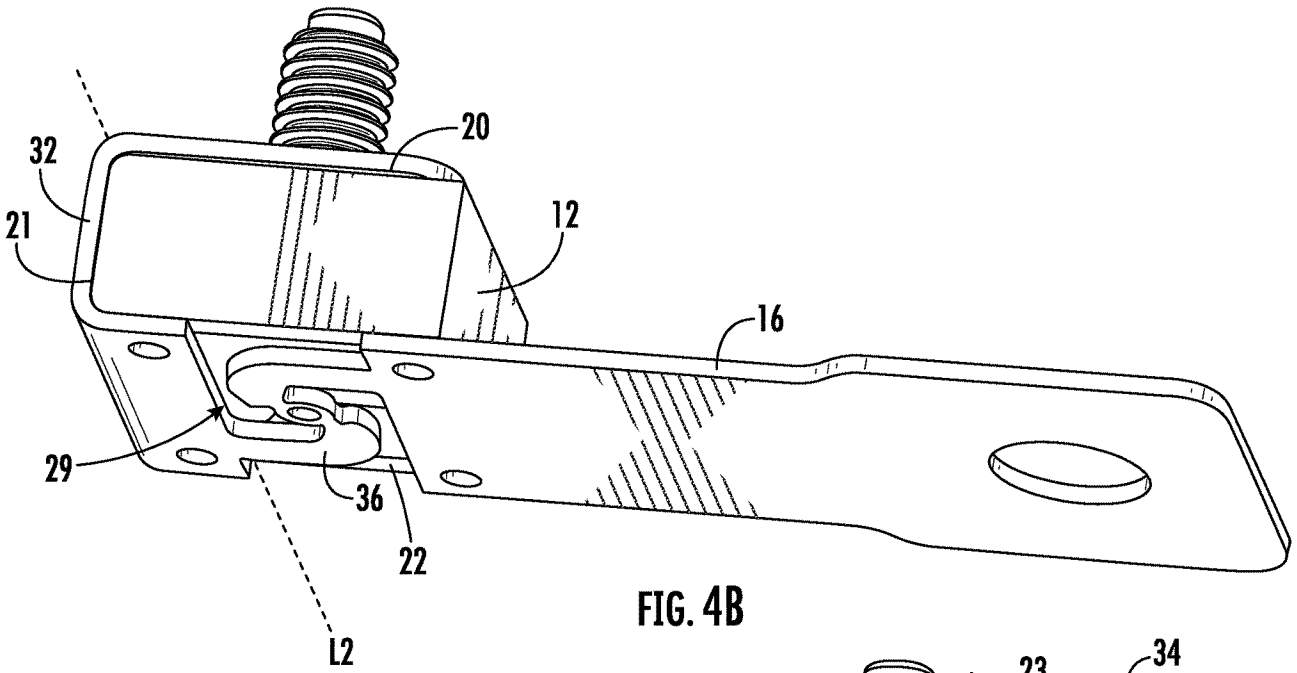
Figure 4C:
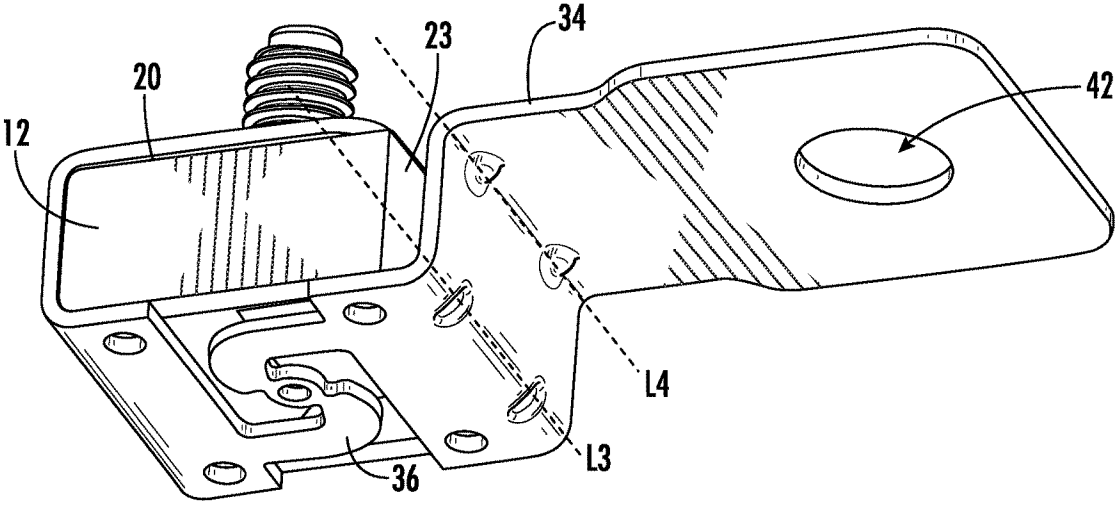

In a third assembly step shown in FIG. 4*c*, the input terminal 34 may be bent or folded 90 degrees about a third fold line L3 that is parallel with the first and second fold lines L1, L2 and that is intermediate the front surface 23 of the mounting block 12 and the mounting aperture 42. A portion of the input terminal 34 proximate the fusible element 36 may thus be disposed in a parallel relationship with the front surface 23. In a fourth assembly step, also shown in FIG. 4*c*, the input terminal 34 may be bent or folded 90 degrees about a fourth fold line L4 that is parallel with the first, second, and third fold lines L1-L3 and that is intermediate third fold line L3 and the mounting aperture 42. A portion of the input terminal 34 distal to the fusible element 36 may thus be disposed in a parallel and substantially coplanar relationship with the top surface 20 of the mounting block 12 and may extend away from the front surface 23 of the mounting block 12.

Referring again to FIG. 1, the cover 18 of the fuse module 10, which may be formed of an electrically insulating material similar to that from which the mounting block 12 is formed, may be fastened to the bottom surface 22 of the mounting block 12 and may cover and enclose the fusible element 36 and the trough 29 (see FIG. 4*b*). The cover 18 may be fastened to the mounting block 12 by any of a variety of fastening means, including, but not limited to, ultrasonic welding, heat staking, epoxy, snap fit locks, etc. The fusible element 36 may thus be disposed within a cavity (e.g., and air gap) defined by the trough 29 (see FIG. 4*b*) and the cover 18, with the cover 18 protecting the fusible element 36 from ambient particulate as well as containing electrical arcing in the fusible element 36 that may occur during an overcurrent condition.

Figure 5:
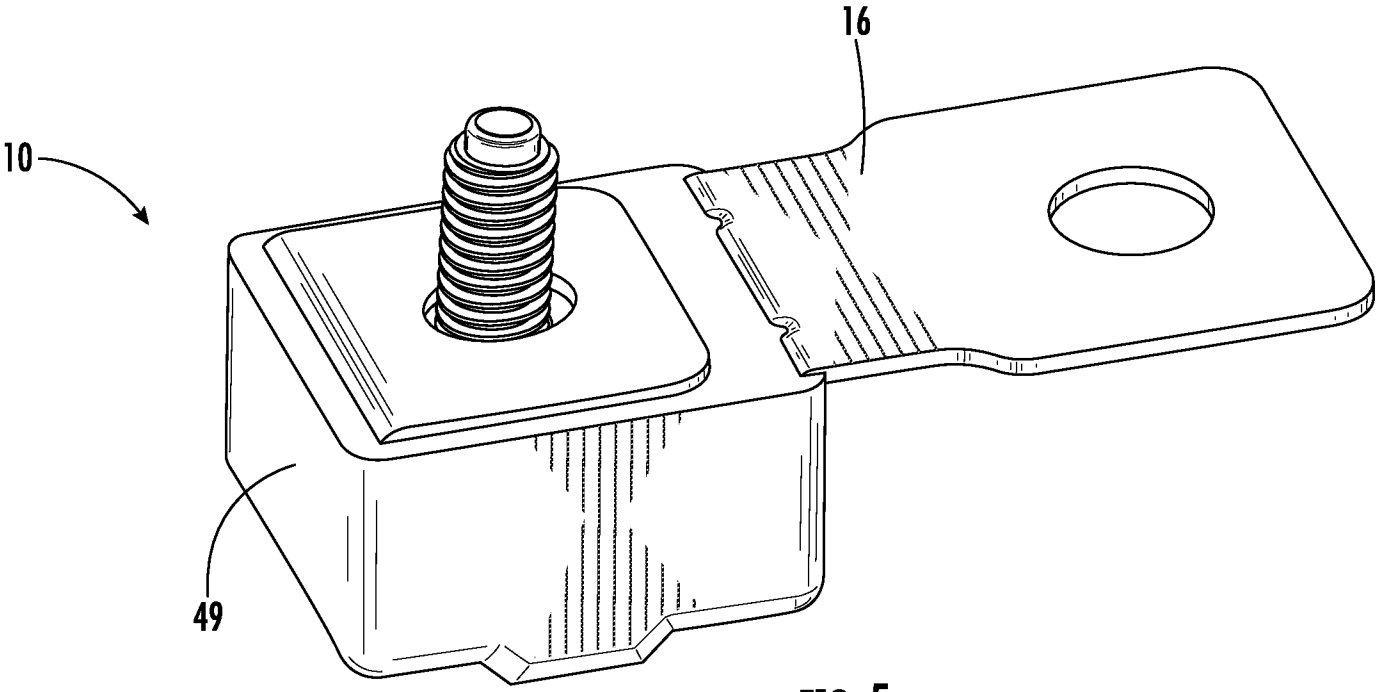
FIG. 5 is a perspective view illustrating the fuse module shown in FIG. 1 including a protective layer.

Referring to FIG. 5, the mounting block 12, the cover 18, and certain portions of the fuse plate 16 may be over-molded with an electrically insulating protective layer 49. The protective layer 49 may be formed of an electrically insulating epoxy, for example, and may protect the fuse module 10 from impact damage, ambient particulate, moisture, etc. During the over-molding process, the cover 18 may prevent the fluidic or semi-fluidic material of the protective layer 49 from entering the air gap in which the fusible element 36 is disposed, thereby preserving the air gap surrounding the fusible element 36.

Figure 6:
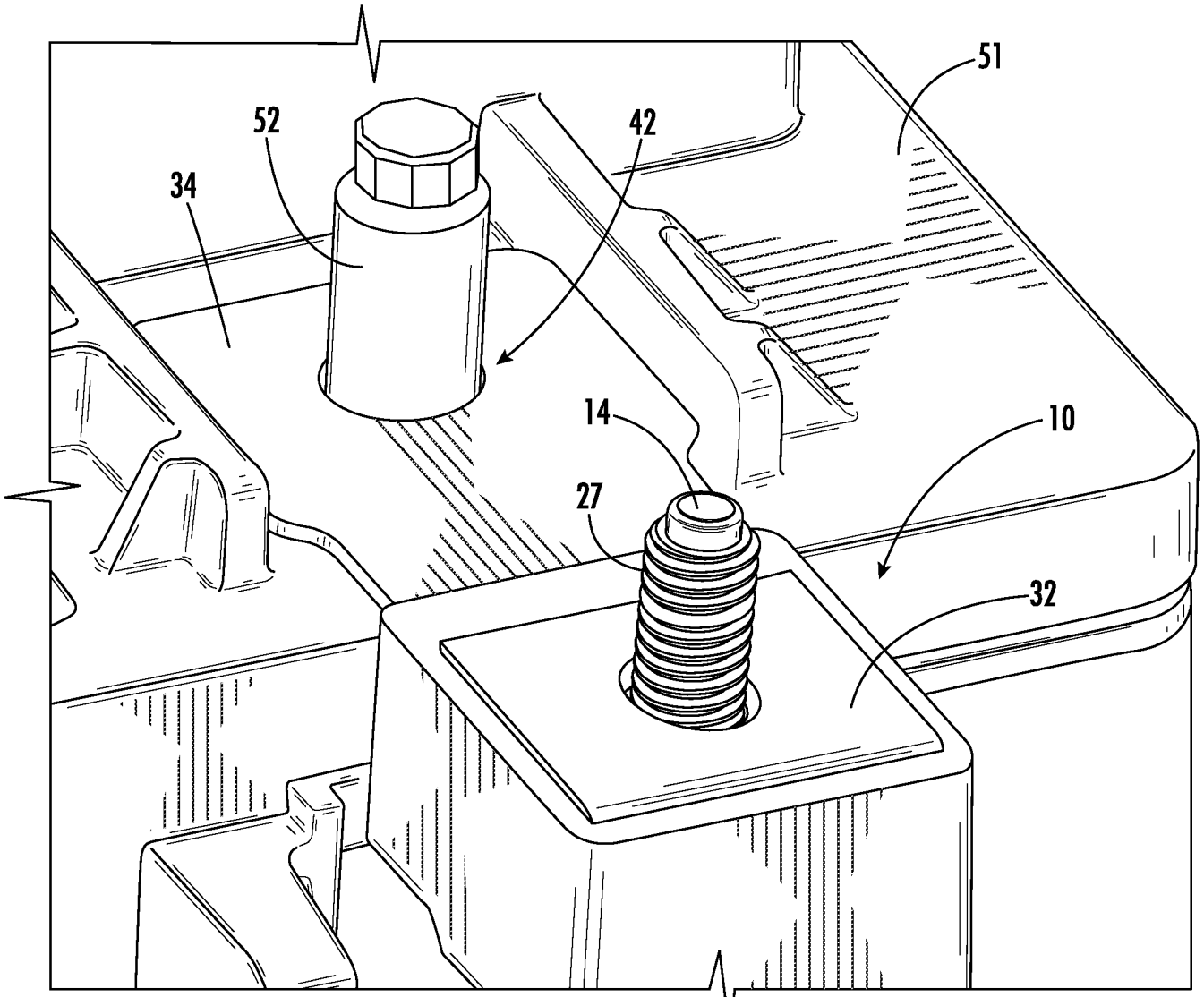
FIG. 6 is a perspective view illustrating the fuse module shown in FIG. 1 installed on an automobile battery.

Referring to FIG. 6, a perspective view illustrating the fuse module 10 installed on an automobile battery 51 is shown. A positive terminal 52 of the automobile battery 51 may extend through the mounting aperture 42 of the input terminal 34 and a majority of the fuse module 10 may hang off of the side of the automobile battery 51. A nut or other fastener (not shown) may be tightened onto the positive terminal 52 and may secure the input terminal 34 to the positive terminal 52 in electrical communication therewith. The terminal post 14 may receive a ring terminal of a conductor (not shown) which may be secured the against the fuse terminal 32 in electrical communication therewith with a nut (not shown) that may be tightened onto the threaded shaft 27 of the terminal post 14. Thus, an electrical system or component of an automobile may be electrically coupled to the positive terminal 52 of the automobile battery 51 via the fuse terminal 32, the fusible element 36, and the input terminal 34, with the fusible element 36 providing overcurrent protection between the automobile battery 51 and such electrical system or component. While the terminal post 14 is depicted as resembling a threaded bolt, it is to be understood that such depiction is provided by way of example only, and that the terminal post 14 may alternatively be embodied by various other types of fasteners or structures that may be similarly adapted for connection with an electrical connector/conductor (e.g., via a ring terminal) extending from an electrical system or component to be protected for establishing an electrical connection between the fuse terminal 32 and such electrical connector/conductor.

It will be appreciated by those of ordinary skill in the art that the fuse module 10 of the present disclosure provides numerous advantages relative to pre-fuse boxes that are currently available on the market. For example, the entire fuse module 10 can be mounted directly to a positive terminal of an automobile battery in close proximity thereto without any flexible conductors extending therebetween. This provides a significant space and material savings relative to conventional pre-fuse boxes.

Figure 7A:
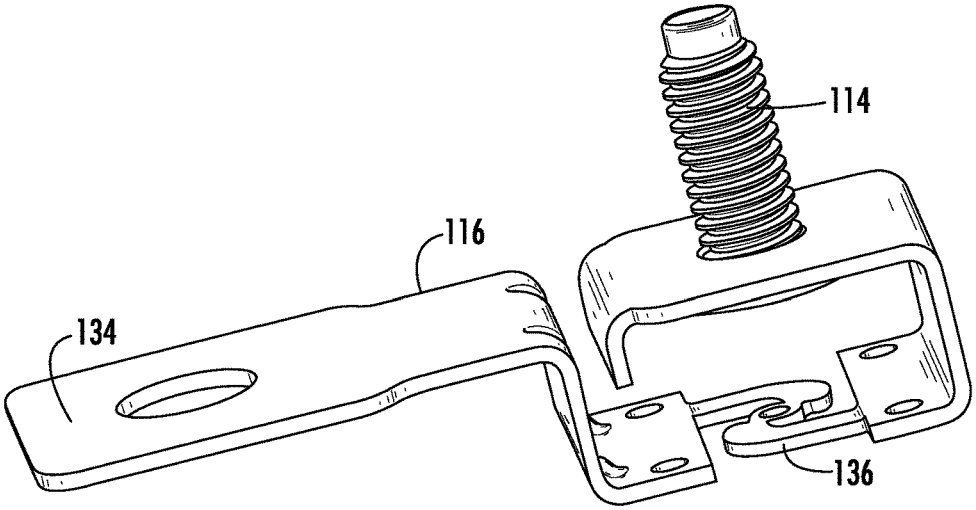
FIG. 7*a*-7*c* are perspective views illustrating another embodiment of a fuse module in accordance with the present disclosure.
Figure 7B:
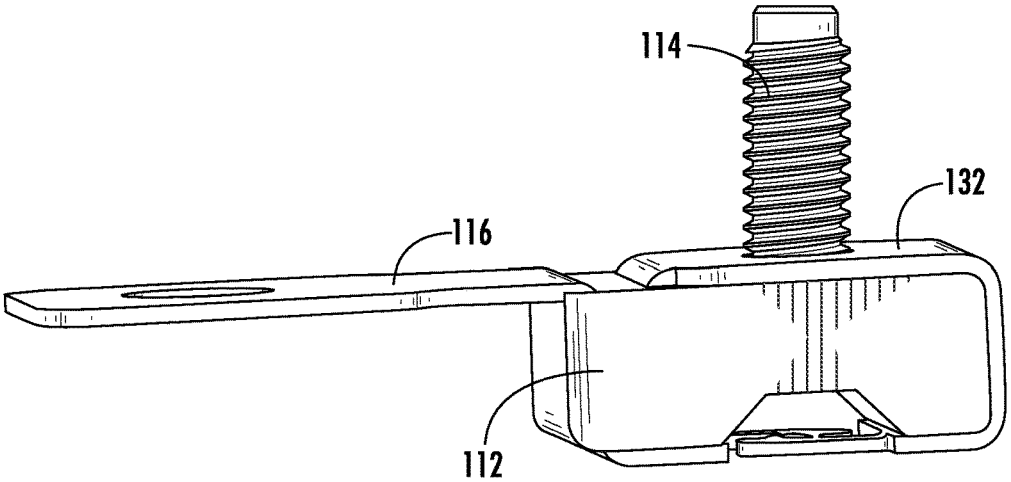
Figure 7C:
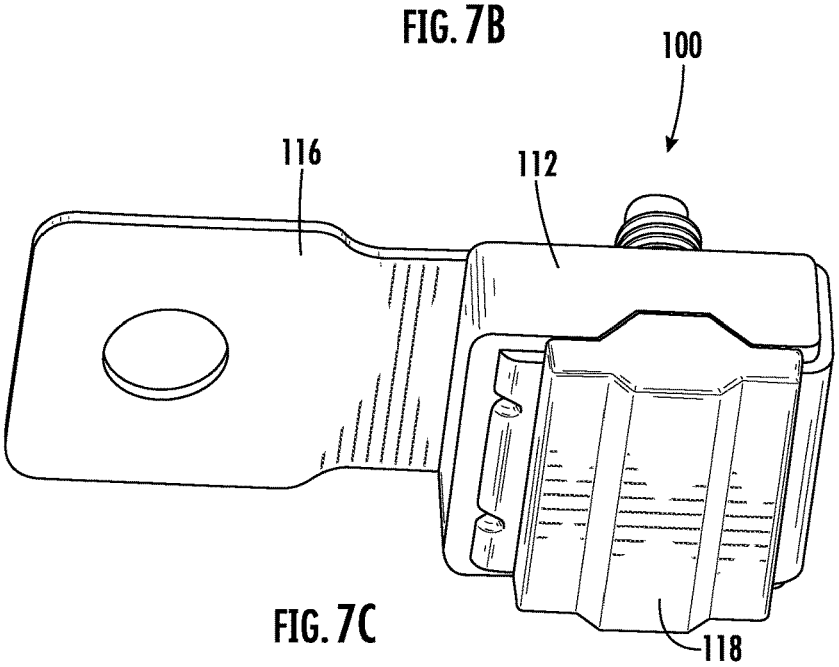

Referring to FIGS. 7*a*-7*c*, a fuse module 100 in accordance with another exemplary embodiment of the present disclosure is shown. The fuse module 100 may be substantially similar to the fuse module 10 described above, and may include a mounting block 112, a terminal post 114, a fuse plate 116, and a cover 118. However, instead of the fuse plate 116 being wrapped or folded about the mounting block 112 as in the fuse module 10, the mounting block 112 may be molded onto the pre-folded fuse plate 116 (e.g., via insert molding), such that portions of the fuse plate 116 are embedded within the mounting block 112. The fuse terminal 132, the input terminal 134, and the fusible element 136 of the fuse plate 116, which may be substantially similar to the fuse terminal 32, the input terminal 34, and the fusible element 36 of the fuse plate 16 described above, may be left exposed. The cover 118 may be fastened to the mounting block 112 in the same manner as described above with respect to the fuse module 10 for protecting the fusible element 136 from ambient particulate as well as for containing electrical arcing in the fusible element 136 that may occur during overcurrent conditions.

Figure 8A:
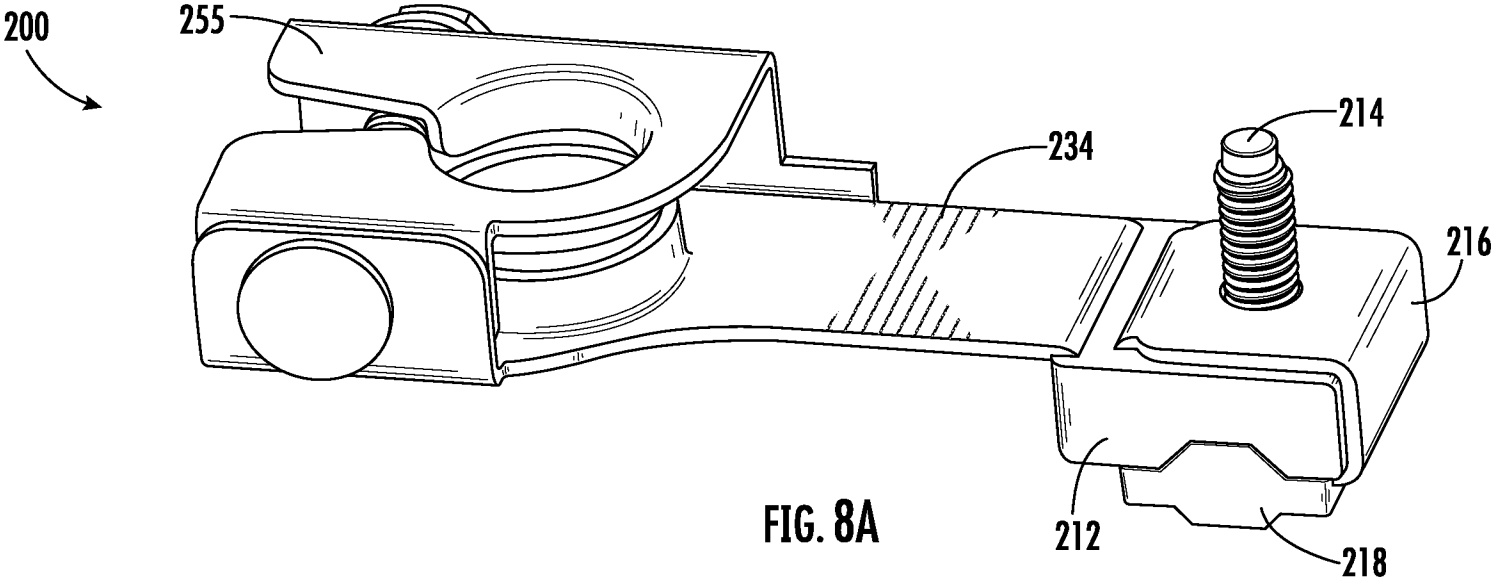
FIGS. 8*a* and 8*b* are perspective views illustrating additional embodiments of fuse modules in accordance with the present disclosure.
Figure 8B:
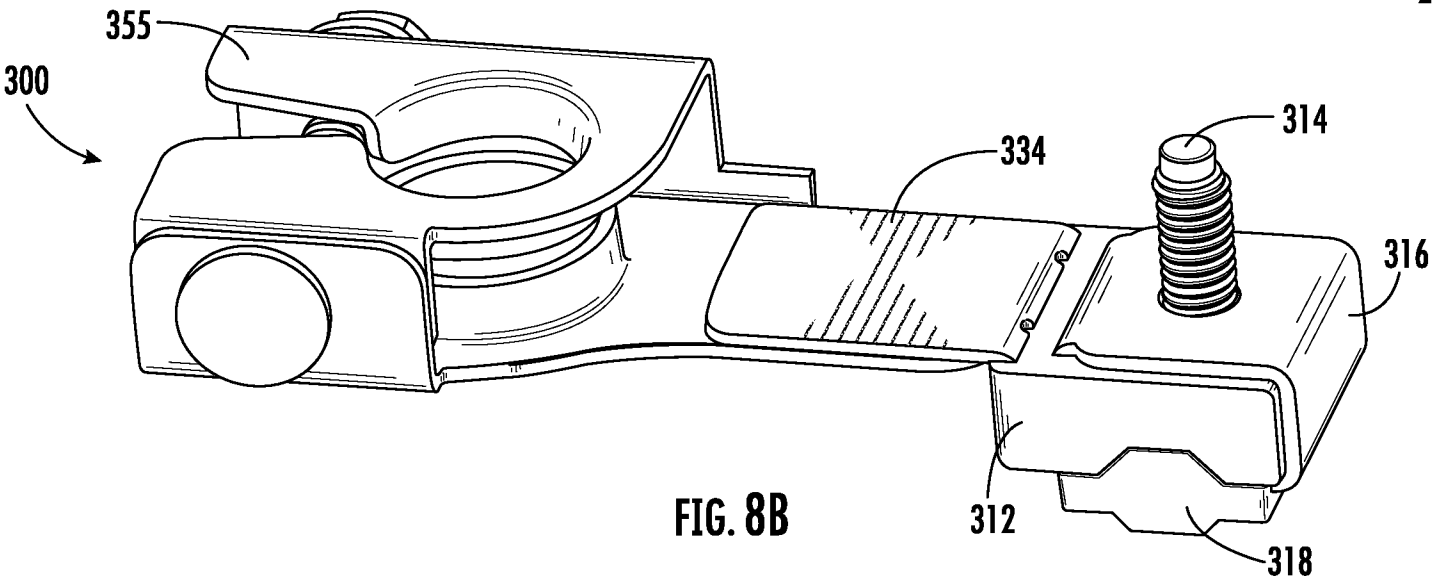

Referring to FIGS. 8*a* and 8*b*, fuse modules 200, 300 in accordance with additional exemplary embodiments of the present disclosure are shown. The fuse modules 200, 300 may be substantially similar to the fuse modules 10 and 100 described above, and may include respective mounting blocks 212, 312, terminal posts 214, 314, fuse plates 216, 316, and covers 218, 318. Additionally, the fuse modules 200, 300 may include respective, integral battery clamps 255, 355 that may extend from respective input terminals 234, 334 of the fuse plates 216, 316. In the embodiment shown in FIG. 8*a*, the battery clamp 255 may be a continuous extension of the input terminal 234 (i.e., may be formed from the same piece of conductive material as the fuse plate 216). In the embodiment shown in FIG. 8*b*, the battery clamp 355 may be formed separately from the fuse plate 316 but may be connected to the input terminal 334, such as via toxing, welding, soldering, etc.

Figure 9A:
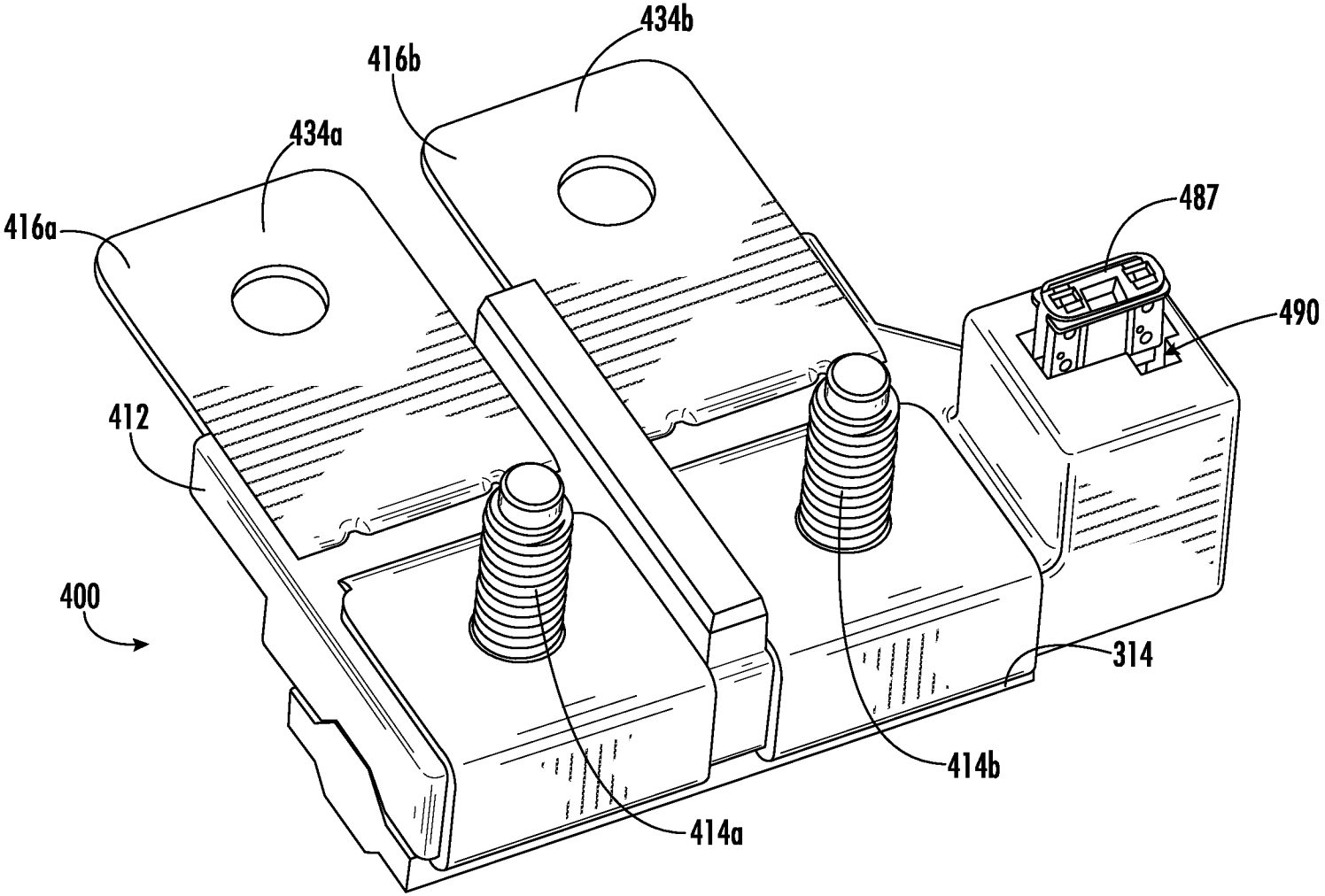
FIGS. 9*a*-9*c* are a series of perspective views illustrating another embodiment of a fuse module in accordance with the present disclosure.
Figure 9C:
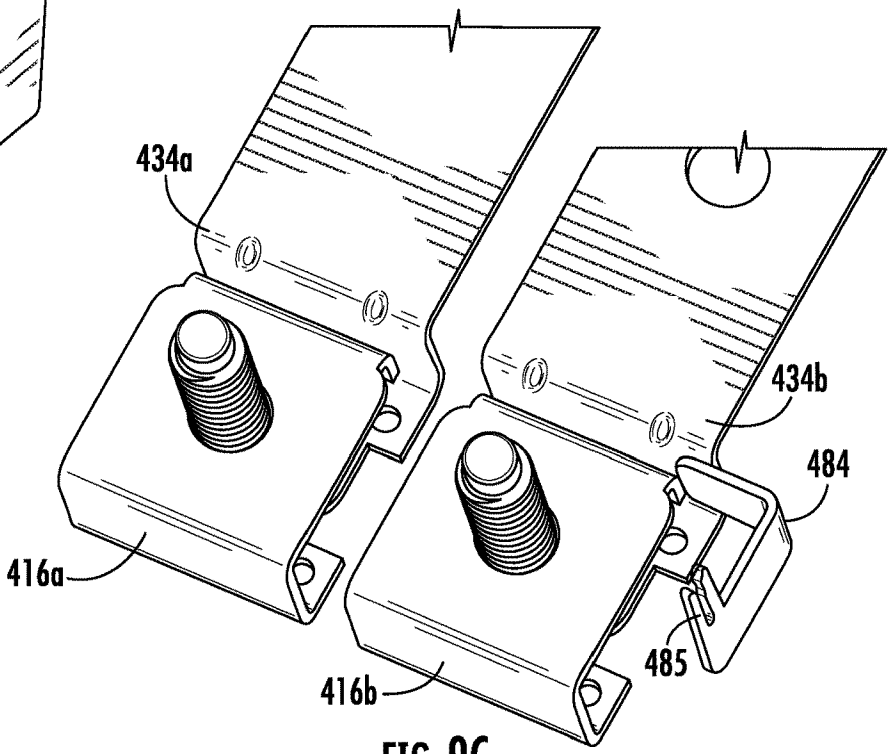
Figure 9B:
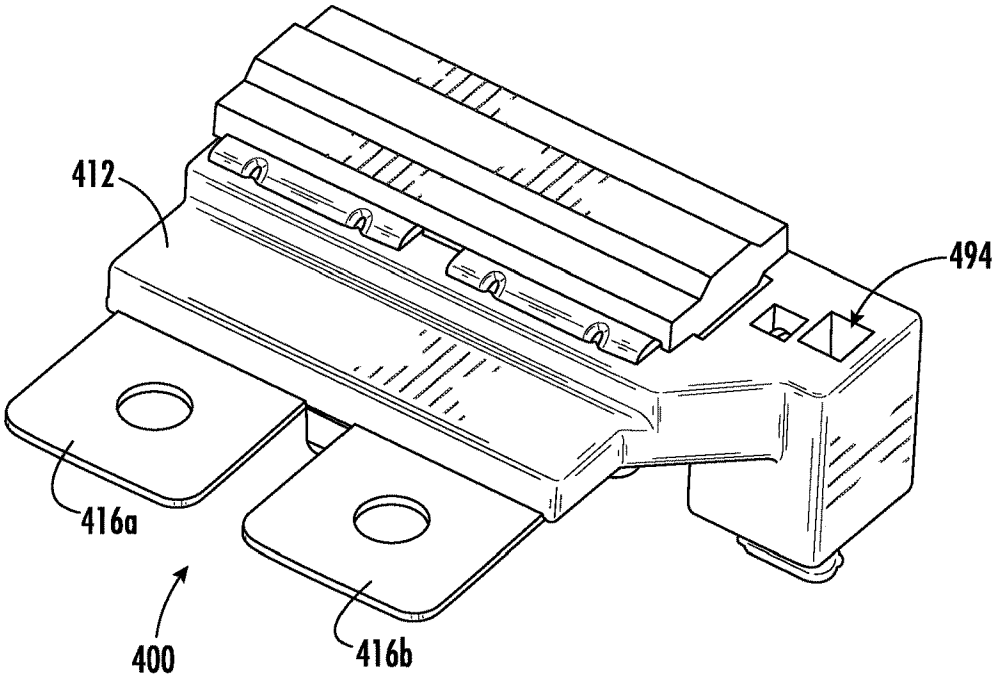

Referring to FIGS. 9*a*-*c*, a fuse module 400 in accordance with another exemplary embodiment of the present disclosure is shown. The fuse module 400 may be substantially similar to the fuse module 100 described above, but may include a plurality of terminal posts 414*a*, 414*b* and a plurality of respective fuse plates 416*a*, 416*b* embedded within a single mounting block 412, wherein the mounting block 412 may be molded onto the terminals posts 414*a*, 414*b* and fuse plates 416*a*, 416*b* (e.g., via insert molding). The fuse module 400 is shown as having two terminal posts 414*a*, 414*b* and two respective fuse plates 416*a*, 416*b*, though it is contemplated that the fuse module 400 may include three or more terminals posts and respective fuse plates without departing from the present disclosure.

The fuse module 400 further differs from the above described fuse module 100 in that the input terminals 434*a*, 434*b* of one or more of the fuse plates 416*a*, 416*b*, which are shown in isolation in FIG. 9*c*, may include a bus extension 484 that is coupled thereto, such as via toxing, welding, soldering, etc. The bus extension 484 may be formed of an electrically conductive material (e.g., copper) and may be shaped and arranged to facilitate the connection of fuses having low-medium amperage ratings (e.g., 5-60 amps) to the fuse module 400. For example, the bus extension 484 may define a forked connector 485 for receiving a leg of a blade fuse 487 (see FIG. 9*a*) that may be seated within a recess 490 formed in the mounting block 412 and that may be connected to an electrical conductor (not shown) that extends through an aperture 494 in the bottom of the mounting block 412 (see FIG. 9*b*). In various embodiments, the bus extension 484 may be an integral, continuous extension of the input terminal 434*b* (i.e., formed as part of the fuse plate 416*b*). In various embodiments, the bus extension 484 may define a male terminal (instead of a female terminal as shown in FIG. 9*c*) for connection to a female terminal of a fuse.

Figure 10A:
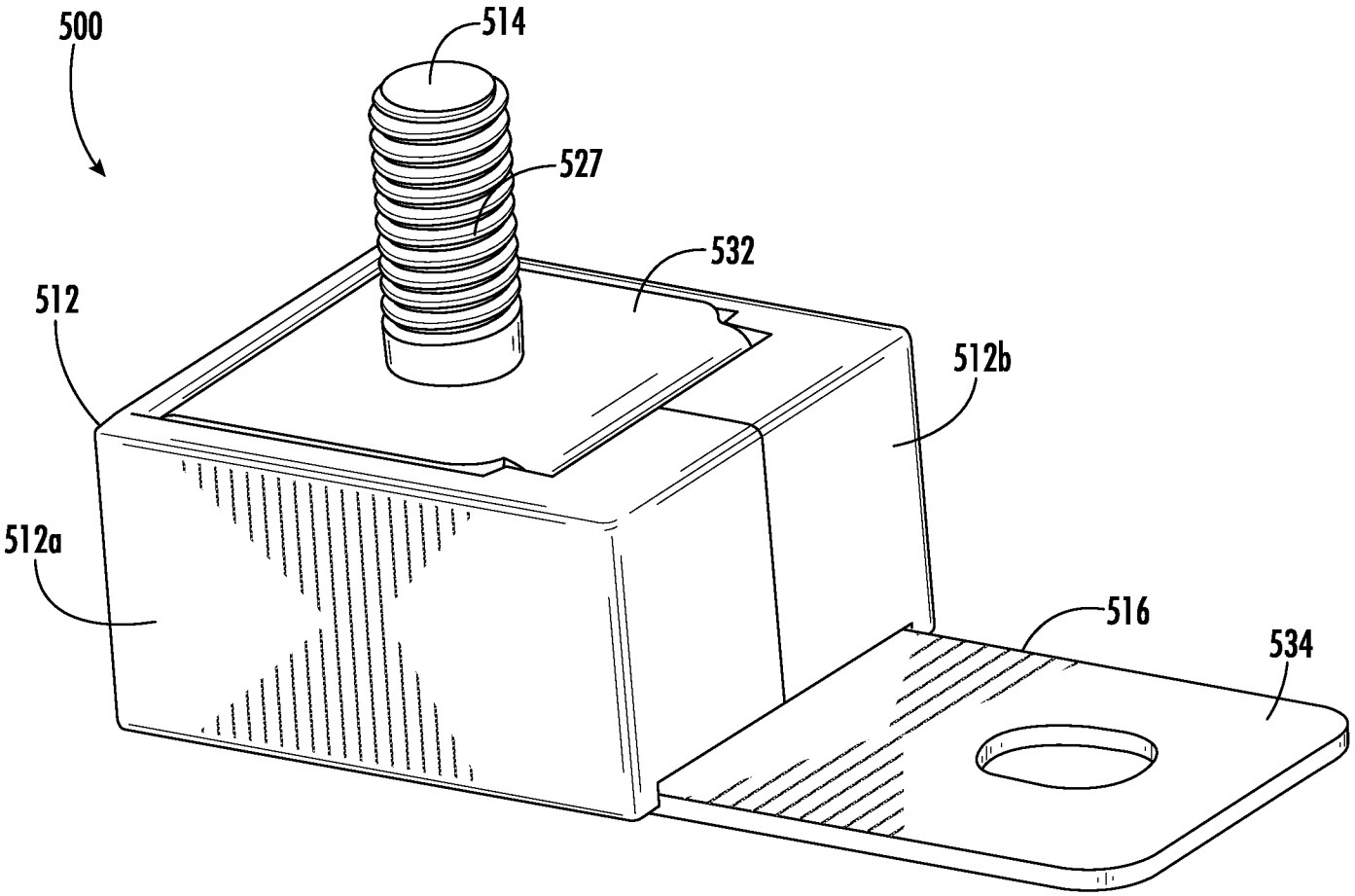
FIGS. 10*a* and 10*b* are perspective views illustrating another embodiment of a fuse module in accordance with the present disclosure.
Figure 10B:
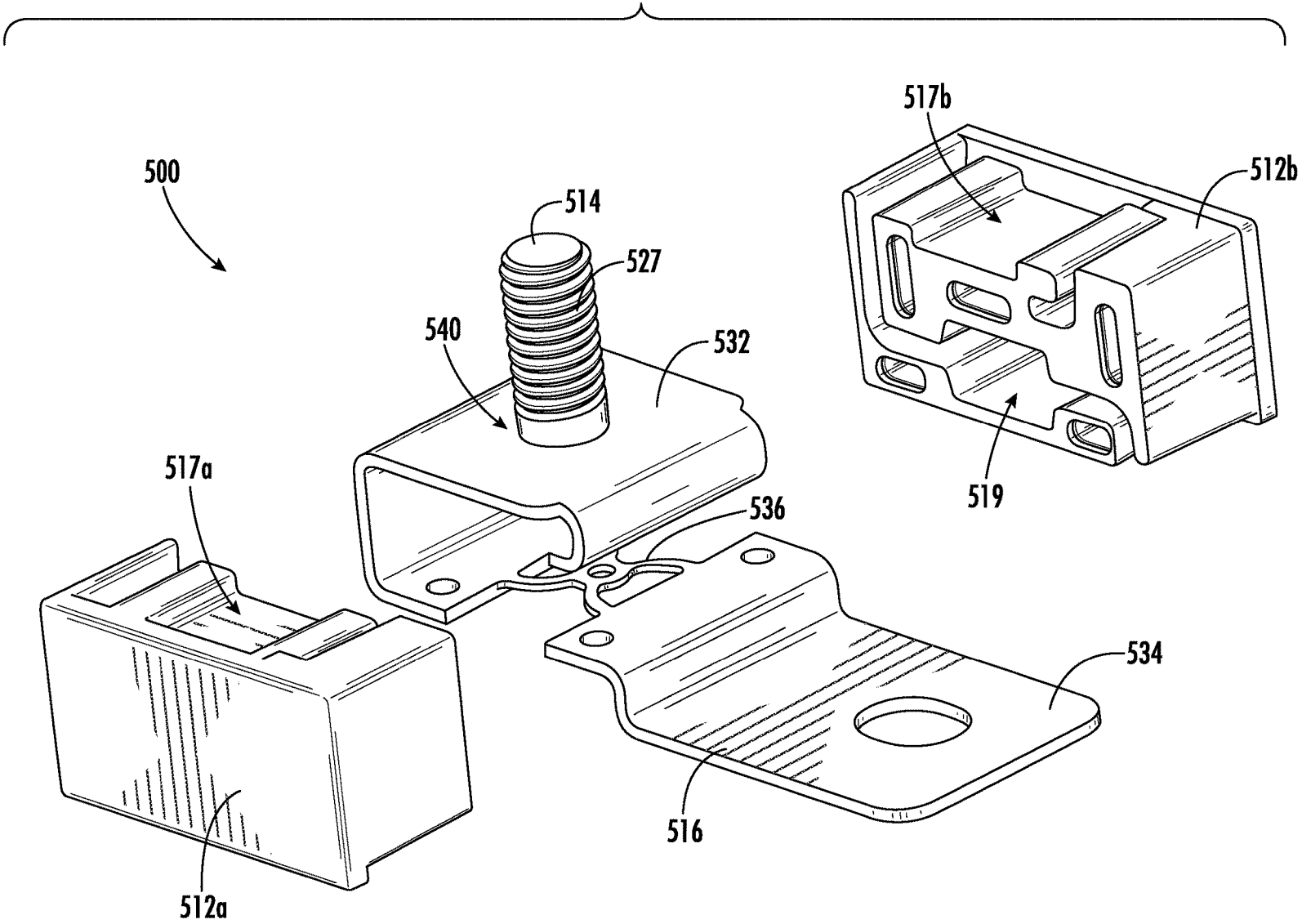

Referring to FIGS. 10*a* and 10*b*, a fuse module 500 in accordance with another exemplary embodiment of the present disclosure is shown. The fuse module 500 may be substantially similar to the fuse module 10 described above, and may similarly include a mounting block 512, a terminal post 514, and a fuse plate 516. However, instead of the fuse plate 516 being wrapped or folded about the mounting block 512 as in the fuse module 10, the fuse plate 516 may be pre-folded into the shape shown in FIG. 10*b*, and the terminal post 514 be may be inserted through the mounting aperture 540 in the fuse terminal 532. The mounting block 512 may include separate first and second mounting block portions 512*a*, 512*b* that may be coupled to one another to encase portions of the fuse plate 516 therein. Particularly, the first and second mounting block portions 512*a*, 512*b*, which may be formed using injection molding or similar processes, may include recesses or channels 517*a*, 517*b* that are formed therein and that may be configured (i.e., sized and shaped) to accommodate portions of the fuse plate 516 and the terminal post 514, with a top surface of the fuse terminal 532 and the threaded shaft 527 of the terminal post 514 left exposed, and with the input terminal 534 extending outside of the mounting block 512 as shown in FIG. 10*a*. In various embodiments, the first and second mounting block portions 512*a*, 512*b* may define a cavity 519 that contains the fusible element 536, wherein the cavity 519 is larger than adjacent portions of the channels 517*a*, 517*b* for providing an air pocket that surrounds the fusible element 536. The first and second mounting block portions 512*a*, 512*b* may be coupled to one another via ultrasonic welding, snap fit, heat staking, adhesives, etc. The present disclosure is not limited in this regard.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse module comprising:

a mounting block formed of an electrically insulating material;

a fuse plate comprising:

a fusible element disposed below a plane defined by a bottommost surface of the mounting block;

a fuse terminal electrically connected to the fusible element and extending along rear and top surfaces of the mounting block; and an input terminal electrically connected to the fusible element and extending from a front surface of the mounting block; and an electrically conductive terminal post extending from the top surface of the mounting block through the fuse terminal for facilitating connection to an electrical component.

2. The fuse module of claim 1, wherein the input terminal has a mounting aperture formed therethrough.

3. The fuse module of claim 1, wherein the fusible element and the input terminal are parallel.

4. The fuse module of claim 1, wherein the fuse terminal and the input terminal are parallel.

5. The fuse module of claim 1, wherein the fuse terminal and the input terminal are coplanar.

6. The fuse module of claim 1, further comprising a cover disposed over the fusible element and fastened to the mounting block.

7. The fuse module of claim 1, further comprising an electrically insulating protective layer encapsulating portions of the fuse plate and the mounting block.

8. The fuse module of claim 1, wherein the input terminal is integral with a battery clamp.

9. The fuse module of claim 1, wherein a portion of the fuse plate is embedded within the mounting block.

10. The fuse module of claim 1, further comprising an electrically conductive bus extension extending from the input terminal, the bus extension adapted for connection to a fuse seated within a recess in the mounting block.

11. A fuse module comprising:

a mounting block formed of an electrically insulating material, the mounting block including first and second portions that fit together and that have interior channels formed therein;

a fuse plate partially disposed within the mounting block and extending through the interior channels of the first and second portions, the fuse plate comprising:

a fusible element disposed below, and oriented parallel to, a plane defined by a bottommost surface of the mounting block;

a fuse terminal electrically connected to the fusible element and extending adjacent, and parallel to, rear and top surfaces of the mounting block; and an input terminal electrically connected to the fusible element and extending from a front surface of the mounting block; and an electrically conductive terminal post extending through the fuse terminal for facilitating connection to an electrical component.

12. The fuse module of claim 11, wherein the input terminal has a mounting aperture formed therethrough.

13. The fuse module of claim 11, wherein the fusible element and the input terminal are parallel.

14. The fuse module of claim 11, wherein the fuse terminal and the input terminal are parallel.

15. The fuse module of claim 11, wherein the fuse terminal and the input terminal are coplanar.

16. The fuse module of claim 11, wherein the fusible element is disposed within a cavity defined by the first and second portions of the mounting block, wherein the cavity defines an air pocket and is larger than adjacent portions of the interior channels of the first and second portions of the mounting block.

17. The fuse module of claim 11, wherein a top surface of the fuse terminal is exposed.

18. The fuse module of claim 11, wherein the first and second portions of the mounting block are fastened to one another by at least one of ultrasonic welding, snap fit, heat staking, and adhesive.

19. The fuse module of claim 11, wherein a portion of the fuse plate is embedded within the mounting block.

20. The fuse module of claim 11, wherein the terminal post and the fuse terminal are perpendicular.

* * * * *